US008057029B2

(12) United States Patent
Kanbara et al.

(10) Patent No.: US 8,057,029 B2
(45) Date of Patent: Nov. 15, 2011

(54) PRINTING APPARATUS

(75) Inventors: Takaaki Kanbara, Tomi (JP); Teruaki Nakayama, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 548 days.

(21) Appl. No.: 12/240,514

(22) Filed: Sep. 29, 2008

(65) Prior Publication Data

US 2009/0160902 A1 Jun. 25, 2009

(30) Foreign Application Priority Data

Dec. 19, 2007 (JP) ..... 2007-327614

(51) Int. Cl.
*B41J 2/185* (2006.01)

(52) U.S. Cl. ..... 347/90

(58) Field of Classification Search ..... 347/90, 347/31, 32, 33, 34, 35, 36
See application file for complete search history.

(56) References Cited

U.S. PATENT DOCUMENTS

2007/0200906 A1* 8/2007 Komatsu ..... 347/90

FOREIGN PATENT DOCUMENTS

JP 11-48498 2/1999

* cited by examiner

*Primary Examiner* — Kristal Feggins
(74) *Attorney, Agent, or Firm* — Ditthavong Mori & Steiner, P.C.

(57) ABSTRACT

A printing apparatus for printing on a medium through which ink ejected onto the surface of the medium is allowed to seep to the back side of the medium. The printing apparatus includes an inkjet head for ejecting ink in accordance with an inkjet method, an ink receiver that is arranged at a position facing the inkjet head across the medium during printing to receive the ink dripping from the back of the medium, and a wiper member as an ink removing device for removing the ink in the ink receiver from the ink receiver.

12 Claims, 8 Drawing Sheets

PRINTING APPARATUS

CROSS-REFERENCE TO RELATED APPLICATION

The present application claims priority to Japanese Patent Application No. 2007-327614, filed on Dec. 19, 2007, the entire contents of which are herein incorporated by reference.

BACKGROUND OF THE INVENTION

1. Field of the Invention

The present invention relates to a printing apparatus.

2. Discussion of the Background

Recently, inkjet printers for printing on a variety of materials as media other than paper have been developed. For example, an inkjet printer capable of printing on a mesh-like medium or a fibrous medium has been developed.

Mesh-like media and fibrous media have coarse texture as compared to paper. Therefore, if printing is conducted on such a medium by an inkjet printer, the medium allows ink ejected onto the surface thereof to seep through the medium to the back side of the medium. As the ink seeps through to the back of the medium, the ink may be deposited on the printing apparatus, causing contamination of medium. Therefore, in case of printing on the aforementioned medium, it is essential to take measures to cope with ink droplets dripping from the back of the medium.

As an example of the coping method, such a method is conceivable to dispose a gutter-like ink receiver for receiving ink droplets dripping from the back of the medium. In this method, the ink receiver may be arranged below the inkjet head to have a slant. The slant lets the ink dripping from the medium flow under its own weight to remove (run off) the ink. Further, such a method is also conceivable to dispose a sponge for absorbing the ink on the gutter of the ink receiver and to replace suitably the sponge with new one.

However, it is difficult to remove all ink only by using the gutter-like receiver having a slant. Ink may remain on the ink receiver and become solidified. Further, if the solidified ink is stacked and/or blocks the flow of ink, the back of the medium may be contaminated by ink remaining on the ink receiver. If the medium is contaminated, the image quality on the medium is degraded, thus spoiling the medium.

In case of disposing the sponge for absorbing the ink, the timing for replacement depends on the frequency of use of machine. Since the absorption property of the sponge deteriorates due to ink fixated to the sponge, it is inconvenient.

Due to the aforementioned problems, these methods require considerable labor for periodic manual maintenance. Accordingly, there is a demand to provide a more suitable method for handling ink dripping from the back of the medium. Therefore, a printing apparatus is needed that is capable of solving the aforementioned problems.

Conventionally, for example, there is known an arrangement of an inkjet printer addressing the need for quickly and reliably collecting waste ink without contaminating the circumference (e.g., see JP-A-H11-48498). However, this arrangement relates to collection of waste ink during maintenance conducted by discharging the ink from each nozzle at the time of non-printing. Further, the collection of waste ink is conducted at a place out of the printing range where the printing is conducted on media. That is, the arrangement is not capable of suitably collecting ink dripping from the back of the medium during printing. Therefore, the aforementioned problems cannot be solved even using this arrangement.

SUMMARY OF THE INVENTION

The present invention advantageously provides a printing apparatus for printing on a medium through which ink ejected onto a surface of the medium is allowed to seep to a back side of the medium. The printing apparatus includes an inkjet head configured to eject ink in accordance with an inkjet method, an ink receiver that is arranged at a position facing the inkjet head across the medium during printing to receive ink dripping from the back of the medium, and an ink removing means for removing the ink in the ink receiver from the ink receiver.

The present invention further advantageously provides a printing apparatus for printing on a medium, where the printing apparatus includes an inkjet head configured to eject ink onto a surface of the medium, an ink receiver that is arranged at a position facing the inkjet head during printing to receive ink dripping from a back of the medium, and an ink removing device configured to remove the ink in the ink receiver from the ink receiver.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 7(*b*) shows the structure of the other end side of the ink receiving unit 14.

DETAILED DESCRIPTION OF EXEMPLARY EMBODIMENTS OF THE INVENTION

Figure 1:
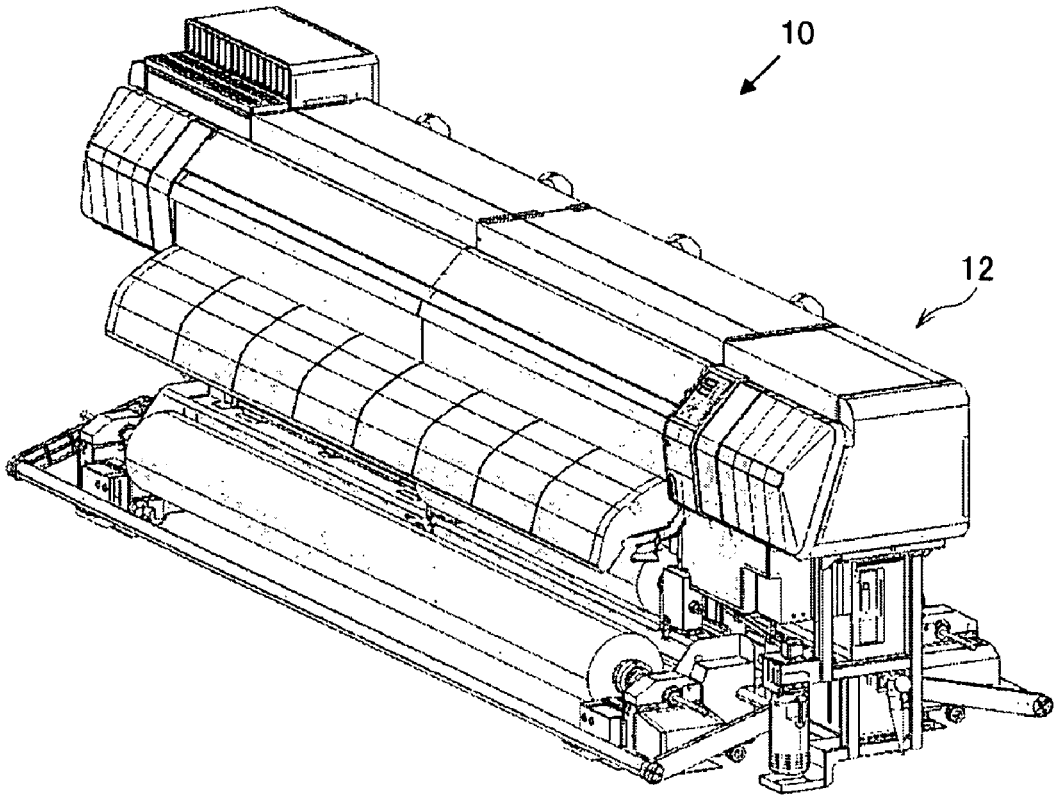
FIG. 1 is an illustration of a main body of a printing apparatus 10 according to an embodiment of the present invention.

Embodiments of the present invention will be described hereinafter with reference to the accompanying drawings. In the following description, the constituent elements having substantially the same function and arrangement are denoted by the same reference numerals, and repetitive descriptions will be made only when necessary.

In a first arrangement according to an embodiment of the present invention, a printing apparatus is provided for printing on a medium through which ink ejected onto the surface of the medium is allowed to seep to the back side of the medium. The printing apparatus includes an inkjet head for ejecting ink in accordance with the inkjet method, an ink receiver which is arranged at a position facing the inkjet head across the medium during printing to receive ink dripping from the back of the medium, and an ink removing means for removing the ink in the ink receiver from the ink receiver.

The medium through which ink ejected onto the surface of the medium is allowed to seep to the back side of the medium is, for example, a medium allowing ink ejected from an inkjet head to drip from the back thereof. Examples of such media include mesh-like media and fibrous media.

According to this arrangement, it is possible to suitably receive the ink dripping from the back of the medium. By using the ink removing means, the ink received by the ink receiver can be suitably removed. Therefore, it is possible to suitably prevent the ink in the ink receiver from being stacked or solidified. Since the ink receiver can be automatically cleaned by operation of the ink removing means, the time and labor for periodical manual maintenance can be significantly reduced, thereby suitably reducing the cleaning time and labor for manually cleaning the ink receiver. As compared to a case of using a sponge or the like for absorbing the ink, it is not required to exchange the sponge or the like.

Here, the ink removing means removes ink in real time, for example, during the printing operation. In this case, for example, the ink removing means preferably operates always at the same time of the printing operation. Further, the ink removing means may start the operation for removing ink in response to the depression of the button or the like during the maintenance of the printing apparatus, for example.

The ink removing means may remove ink, for example, when the printer apparatus is in stand-by state (sleeping state). According to this arrangement, it is possible to suitably prevent the solidification of residual ink in an unattended environment, i.e. without any user.

In a second arrangement, the printing apparatus is a printing apparatus of a scanning type in which the printing is conducted while reciprocating the inkjet head in a previously set main scanning direction, and the ink receiver is a gutter-like member extending in the main scanning direction.

According to this arrangement, ink droplets dripping from the back of the medium can be suitably received. By using the gutter-like ink receiver being small in width direction, the ink receiver can be suitably formed to be small in size.

The ink receiver spreads in a wide area larger than the width of the medium in the main scanning direction, for example. According to this arrangement, ink droplets are suitably received. The printing apparatus is preferably a printing apparatus of a paper-moving type in which the printing is conducted while feeding a medium in a sub scanning direction perpendicular to the main scanning direction. According to this arrangement, it is not required to move the ink receiver so that ink can be suitably received.

In a third arrangement, the ink removing means is a wiper member which is slidable along the gutter-like ink receiver and is adapted to remove the ink in the ink receiver by traveling within the ink receiver in the main scanning direction. According to this arrangement, for example, ink in the ink receiver can be suitably removed. The wiper member slides along the ink receiver in the longitudinal direction of the ink receiver.

The printing apparatus further includes, for example, a driving section for driving the wiper member. The driving section moves a wire to which the wiper member is attached so as to drive the wiper member. The wire is tensioned and extends within the ink receiver in the main scanning direction.

In a fourth arrangement, the printing apparatus further includes a controller for controlling the operation of the wiper member in the main scanning direction, wherein the controller changes the stand-by position of the wiper member for every operation in which the wiper member travels a predetermined amount, the stand-by position being a position within the ink receiver where the wiper member stands by when it is not in operation.

As the ink is removed by the wiper member, the ink adheres to the wiper member. Accordingly, as the wiper member is stopped after removal of ink, the ink directly below the wiper member may be solidified at the stand-by position where the wiper member is stopped. If the wiper member is stopped at the same position every time, the solidified ink may be stacked at the position by the repetition of the traveling and stopping of the wiper member. The stacked solidified ink may contaminate the back of the medium and further may block the operation of the wiper member.

According to the fourth arrangement, however, even though the ink directly below the wiper member is solidified, the stand-by position of the wiper member is suitably changed, thereby distributing the position where ink is solidified. Therefore, it is possible to suitably prevent the problem caused due to stacking of solidified ink.

It should be noted that the operation of the wiper member of traveling a predetermined amount means that the wiper member conducts reciprocation traveling within the ink receiver for a predetermined number of times or more or for a predetermined period of time or more. The controller may change the stand-by position of the wiper member for every a predetermined number of times of the stand-by of the wiper member. For example, the controller may change the stand-by position of the wiper member definitely every operation. In case of changing the stand-by position of the wiper member, the controller may change the stand-by position within the operation range of the wiper member in a random manner, for example.

In a fifth arrangement, the ink removing means is a belt member extending in the main scanning direction over the bottom surface of the gutter-like ink receiver and moves along the bottom surface of the ink receiver to remove the ink in the ink receiver. The printing apparatus further includes a driving section for driving the belt member. The belt member is a band-like member having a movable ink receiving surface. According to this arrangement, the ink in the ink receiver can be suitably removed, for example.

According to an embodiment of the present invention, ink droplets dripping from the back of the medium is received by the ink receiver and is suitably removed. This arrangement also suitably reduces the cleaning time and labor for manually cleaning the ink receiver, for example.

Figure 2:
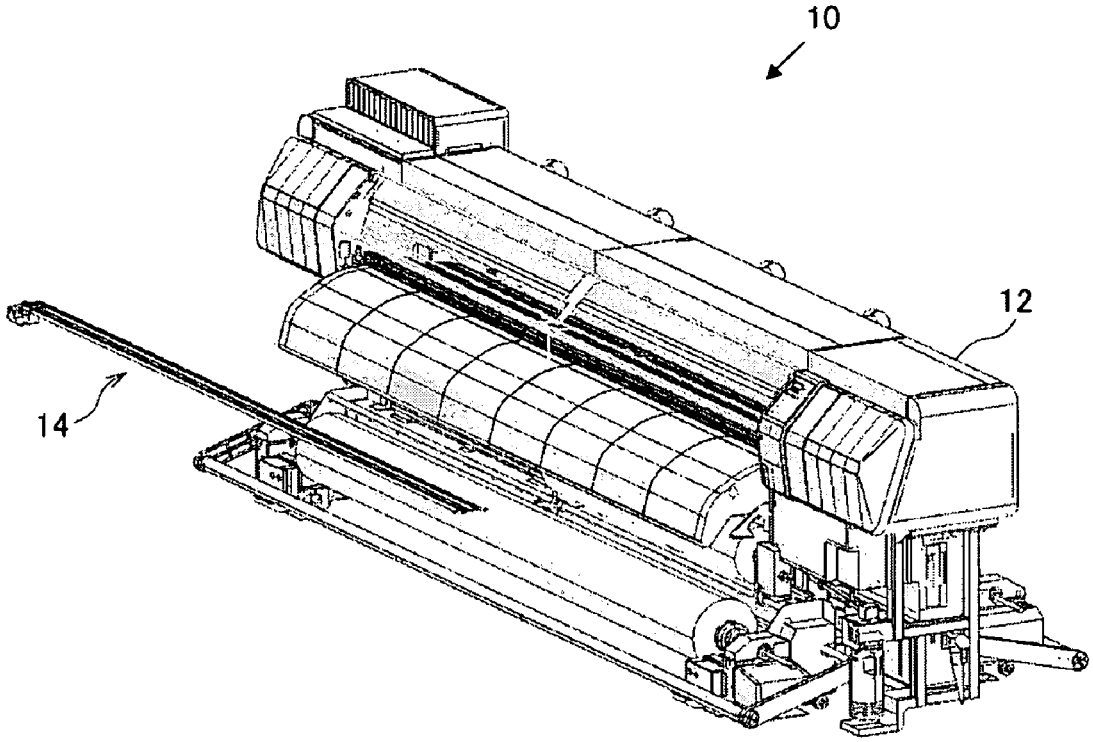
FIG. 2 is an illustration showing an attaching state that an ink receiving unit 14 is attached to a main body 12 of the printing apparatus 10.
Figure 3A:
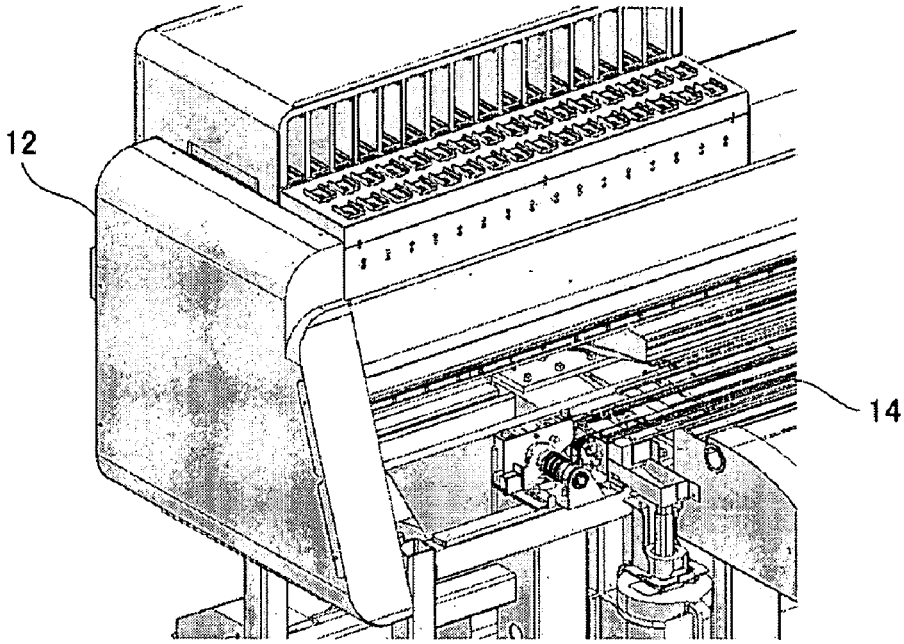
FIGS. 3(*a*), 3(*b*) are enlarged views of attached portions of the ink receiving unit 14, where FIG. 3(*a*) is an enlarged view of one end side of the ink receiving unit 14, and FIG. 3(*b*) is an enlarged view of the other end side of the ink receiving unit 14.
Figure 3B:
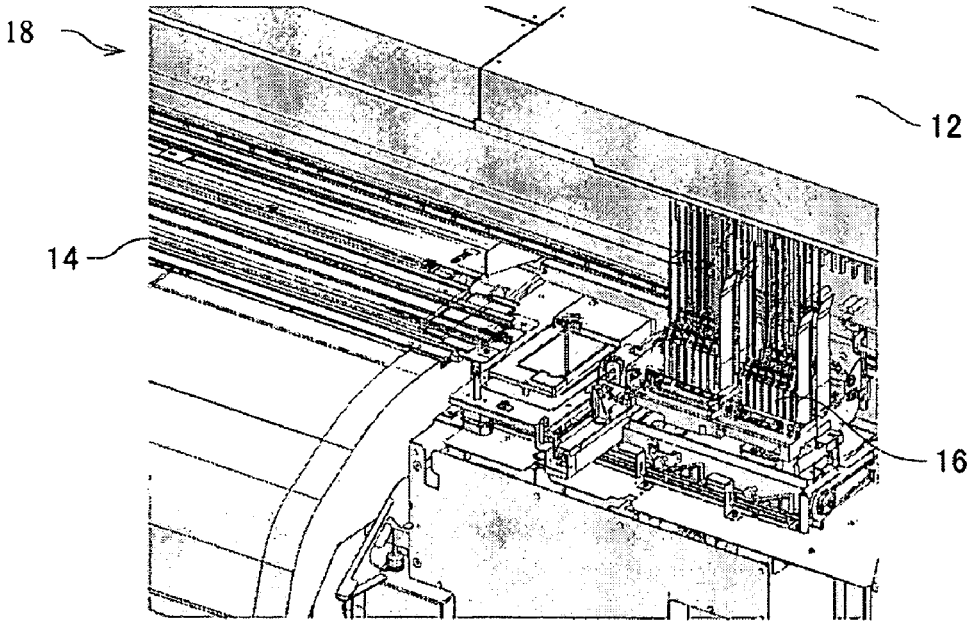

FIGS. 1-3(*b*) show an example of arrangement of printing apparatus 10 according to an embodiment of the present invention. FIG. 1 shows appearance of a main body of the printing apparatus 10. FIG. 2 shows an attaching state that an ink receiving unit 14 is attached to the main body 12 of the printing apparatus 10. FIGS. 3(*a*) and 3(*b*) are enlarged views of attached portions of the ink receiving unit 14. FIG. 3(*a*) is an enlarged view of one end side of the ink receiving unit 14. FIG. 3(*b*) is an enlarged view of the other end side of the ink receiving unit 14.

The printing apparatus 10 is an inkjet printer of a scanning type in which the printing is conducted while reciprocating an inkjet head thereof in a previously set main scanning direction. The printing apparatus 10 is a printing apparatus of a paper-moving type in which the printing is conducted while feeding a medium in a sub scanning direction perpendicular to the main scanning direction. Further, in this embodiment, the printing apparatus 10 is a printing apparatus for printing on a medium through which ink ejected onto the surface of the medium is allowed to seep to the back side of the medium and includes a main body 12 and an ink receiving unit 14. The medium through which ink ejected onto the surface of the medium is allowed to seep to the back side of the medium is a medium allowing ink ejected from an inkjet head to drip from the back thereof, for example, mesh-like media and fibrous media.

The main body 12 is a main portion of the printing apparatus 10 for printing on the medium. In this embodiment, the ink receiving unit 14 is attached to the main body 12. The main body 12 has an inkjet head 16 and a controller 18 therein. The inkjet head 16 is a print head for ejecting ink in accordance with the inkjet method. The controller 18 is a control device such as a CPU for controlling respective components of the printing apparatus 10. Though only some components have been described in the above for ease of explanation, the main body 12 suitably includes components required for printing, such as a feeding member for feeding media.

The ink receiving unit 14 is a member for receiving ink droplets dripping from the back of the medium and is detachably attached to the main body 12. In this embodiment, the ink receiving unit 14 is mounted such that the longitudinal direction thereof extends parallel to the main scanning direction. At least during printing, an ink receiver which receives ink droplets in the ink receiving unit 14 faces the inkjet head 16 across a medium. The ink receiver spreads in a wide area larger than the width of the medium in the main scanning direction. According to this embodiment, ink droplets dripping from the back of the medium can be suitably received.

In a variation example of the present invention, the arrangement for receiving ink droplets may not be structured as a unit and an arrangement corresponding to the ink receiving unit 14 may be formed in the main body 12. In the state shown in FIG. 3(*b*), the inkjet head 16 stands by at a position outside of the ink receiving unit 14. However, during printing, the inkjet head 16 reciprocates in the main scanning direction. Accordingly, during printing, the ink receiver of the ink receiving unit 14 and the inkjet head 16 face each other across the medium. The distance between the inkjet head 16 and the ink receiver is in a range of from 3 to 10 mm, for example, and more preferably from 5 to 7 mm. According to this structure, ink droplets dripping from the back of the medium can be suitably received with the medium laying between the inkjet head 16 and the ink receiver.

Figure 4A:
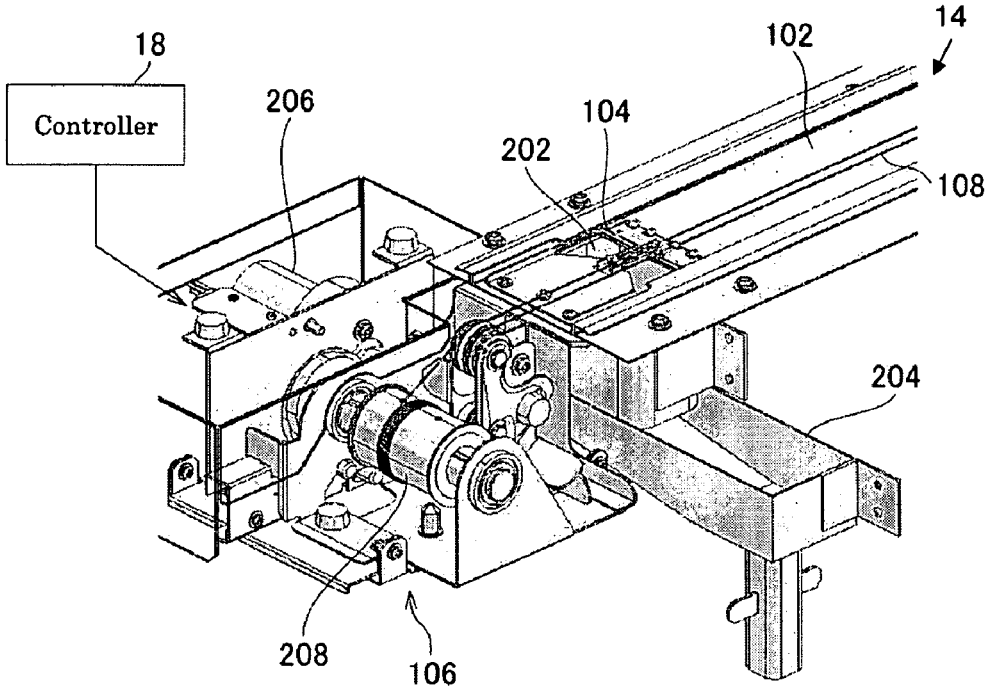
FIGS. 4(*a*), 4(*b*) are illustrations showing a first example of specific structure of the ink receiving unit 14, where FIG. 4(*a*) shows the structure of one end side of the ink receiving unit 14, and FIG. 4(*b*) shows the structure of the other side of the ink receiving unit 14.
Figure 4B:
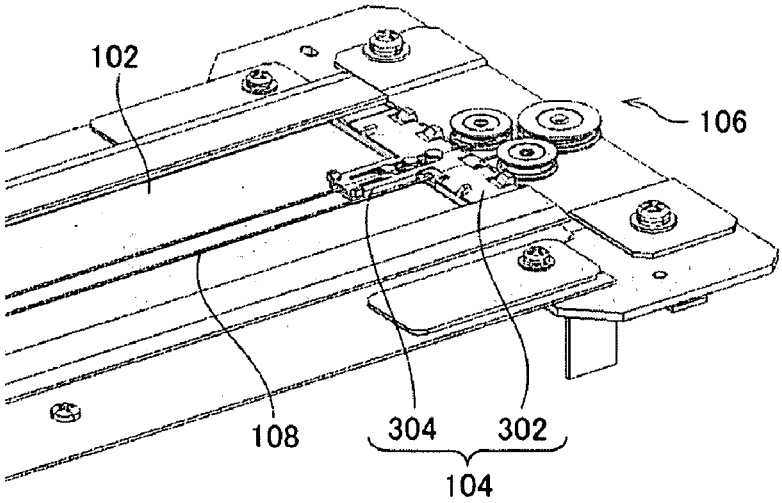

FIGS. 4(*a*) and 4(*b*) show a first example of specific structure of the ink receiving unit 14. FIG. 4(*a*) shows the structure of one end side of the ink receiving unit 14 as well as some parts of the main body 12 (see FIG. 1). FIG. 4(*b*) shows the structure of the other side of the ink receiving unit 14.

In this example, the ink receiving unit 14 has an ink receiver 102, a wiper member 104, and some parts composing a driving section 106. The ink receiver 102 is a gutter-like waste ink tray for receiving ink droplets dripping from the back of the medium. In the example, the ink receiver 102 extends in the main scanning direction when the ink receiving unit 14 is attached to the main body 12. Formed on one end of the ink receiver 102 is an ink discharge port 202. The ink discharge port 202 is an opening for discharging waste ink received by the ink receiver 102 to the outside. The ink discharge port 202 is connected to a discharge passage 204 formed in the main body 12 so that waste ink is discharged by flowing the waste ink through the discharge passage 204.

In this example, the ink discharge port 202 is formed at the end, near the driving section 106, of the ink receiver 102. Accordingly, the ink receiving unit 14 collects waste ink by moving the wiper member 104 in a direction toward the driving section 106. Another ink discharge port 202 may also be formed at the end, far from the driving section 106, of the ink receiver 102. With this structure, waste ink can be also collected by moving the wiper member 104 in a direction apart from the driving section 106.

The wiper member 104 is an example of ink removing means for removing the ink in the ink receiver 102 from the ink receiver 102. In this example, the wiper member 104 slides in the main scanning direction corresponding to the longitudinal direction of the ink receiver 102. The wiper member 104 removes the ink in the ink receiver 102 by sliding and traveling along the gutter-like ink receiver 102. Therefore, the wiper member 104 functions as a waste ink wiper to clean the ink receiver 102 by forcibly removing the ink in the ink receiver 102. In this manner, this example can suitably remove the ink in the ink receiver 102.

In this example, the wiper member 104 has a substantially T-like shape and has a widespread portion 302 extending in the width direction of a gutter-like groove of the ink receiver 102 and a wire connecting portion 304 projecting from the center of the widespread portion toward one end of the ink receiver 102. The widespread portion 302 is a portion corresponding to a head portion of the character T and has a structure of spreading in the width direction of the ink receiver 102 so as to enable the widespread portion 302 to push out the ink in the ink receiver 102 according to the sliding of the wiper member 104. The wire connecting portion 304 is a portion corresponding to a leg portion of the character T and is connected to a wire 108 for driving the wiper member 104. Therefore, the wiper member 104 is moved along the ink receiver 102 when subjected to force of the driving section 106 through the wire 108.

The driving section 106 has a motor, gears, and the like for driving the wiper member 104. In this example, the driving section 106 has a driving motor 206 and a wire drum 208. The driving motor 206 rotates the wire drum 208 according to a command from the controller 18. The wire drum 208 is a drum on which the wire 108 is wound and moves the wire 108 according to the output power of the driving motor 206. Therefore, the driving section 106 drives the wiper member 104 via the wire 108 according to the command of the controller 18.

In this example, the driving section 106 also comprises gears and/or pulleys, for example. The driving section 106 is structured by combining respective components on the main body 12 and the ink receiving unit 14. Specific structure of the driving section 106 will be further described later.

The wire 108 is a driving wire transmitting the power of the driving section 106 to the wiper member 104. In this example, the wire 108 is tensioned to extend in the longitudinal direction of the ink receiver 102 by pulleys of the driving section 106 in the ink receiver 102.

In this example, the wire 108 is tensioned to extend to make a round trip (loop) in the ink receiver 102 by and between the wire drum 208 and the pulley, disposed on one end side of the ink receiving unit 104, of the driving section 106 and a plurality of pulleys, disposed on the other end side of the ink receiving unit 104, of the driving section 106. A part corresponding to one way of the round trip of the wire 108 is tensioned to extend along the center in the width direction of the ink receiver 102. The wire connecting portion 304 of the wiper member 104 is attached to the part of the wire extending along the center. Thus, the wire 108 holds the T-like wiper member 104 at the center of the wiper member 104 (center holding). When the wiper member 104 is held at the center, the wiper member 104 is held at its center of gravity so that the wiper member 104 does not practically rattle and the wiper member 104 can stably travel.

As a method for holding the wiper member 104 using the wire 108, there is conceivable a method of holding one side of the wiper member 104 (cantilever holding) instead of center holding. However, the cantilever holding makes the wiper member 104 more easily rattle so that it may be difficult to drive the wiper 104 to stably travel. As measures for preventing the rattling are taken, the apparatus may be increased in size and in cost. Further, the workability may become worse. However, according to this example, the wiper member 104 is held at the center, thereby driving the wiper member 104 to stably travel without increasing the size of the apparatus.

As mentioned above, according to this example, ink received by the ink receiver 102 can be suitably removed by the wiper member 104. Therefore, it is possible to suitably prevent the ink in the ink receiver 102 from being stacked or solidified. Since the ink receiver 102 can be automatically cleaned by movement of the wiper member 104, the cleaning time and labor for manually cleaning the ink receiver 102 can be suitably reduced. Moreover, it is possible to conduct the collection of waste ink all over the printing area at a side behind the medium, thereby removing the waste ink at the same time of printing, for example. Therefore, stacking and solidification of ink can be suitably prevented.

Hereinafter, the control of movement of the wiper member 104 by the controller 18 will be further described in detail. In this example, the controller 18 controls the wiper member 104 to operate, for example, when the printing apparatus 10 (see FIG. 1) conducts printing operation. Accordingly, the wiper member 104 removes ink in real time during the printing operation.

The controller 18 may control the wiper member 104 to operate in response to depression of a button or the like during maintenance of the printing apparatus, for example. In this case, the depression of the button or the like makes the wiper member 104 start to remove ink. The controller 18 may control the wiper member 104 to operate at regular time intervals for example when the printer apparatus is in stand-by state (sleeping state). Accordingly, it is possible to suitably prevent the solidification of residual ink in an unattended environment, i.e. without any user.

In this example, the controller 18 changes the stand-by position of the wiper member 104 for every operation in which the wiper member 104 travels a predetermined amount. The stand-by position of the wiper member 104 is a position within the ink receiver where the wiper member 104 stands by when it is not in operation. For example, the controller 18 changes the stand-by position in a random manner every time when stopping the wiper member 104 after the operation.

When the wiper member 104 is stopped to stand by, ink adhering to a portion directly below the wiper member 104 may be solidified in the stand-by position. According to this example, however, even though the ink adhering to a portion directly below the wiper member 104 is solidified, the position where ink is solidified is distributable. Therefore, it is possible to suitably prevent the problem caused due to stacking of solidified ink. Further, it is therefore possible to suitably remove waste ink.

Figure 5:
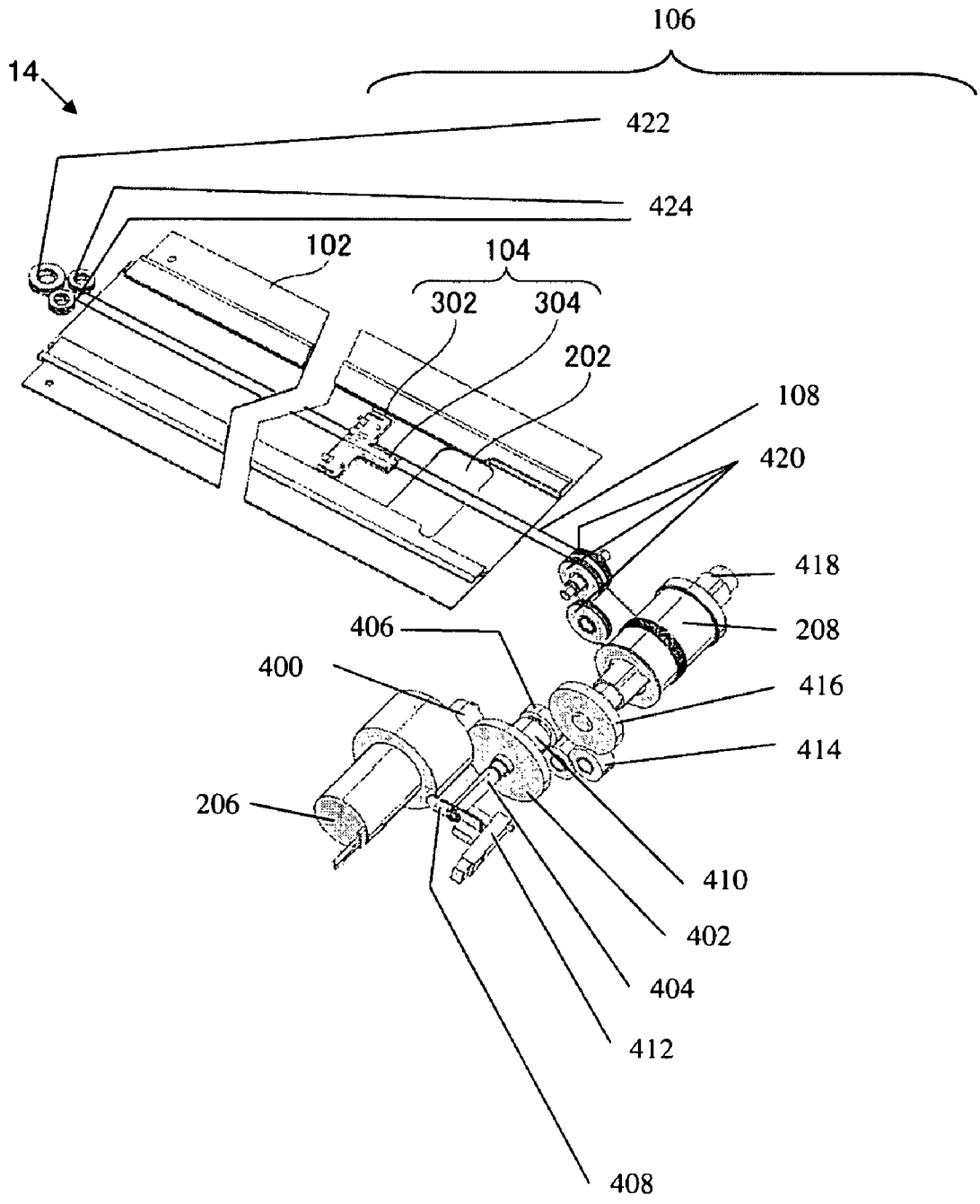
FIG. 5 is a perspective view of an upper side of the ink receiver 102 as taken from the rear left.
Figure 6:
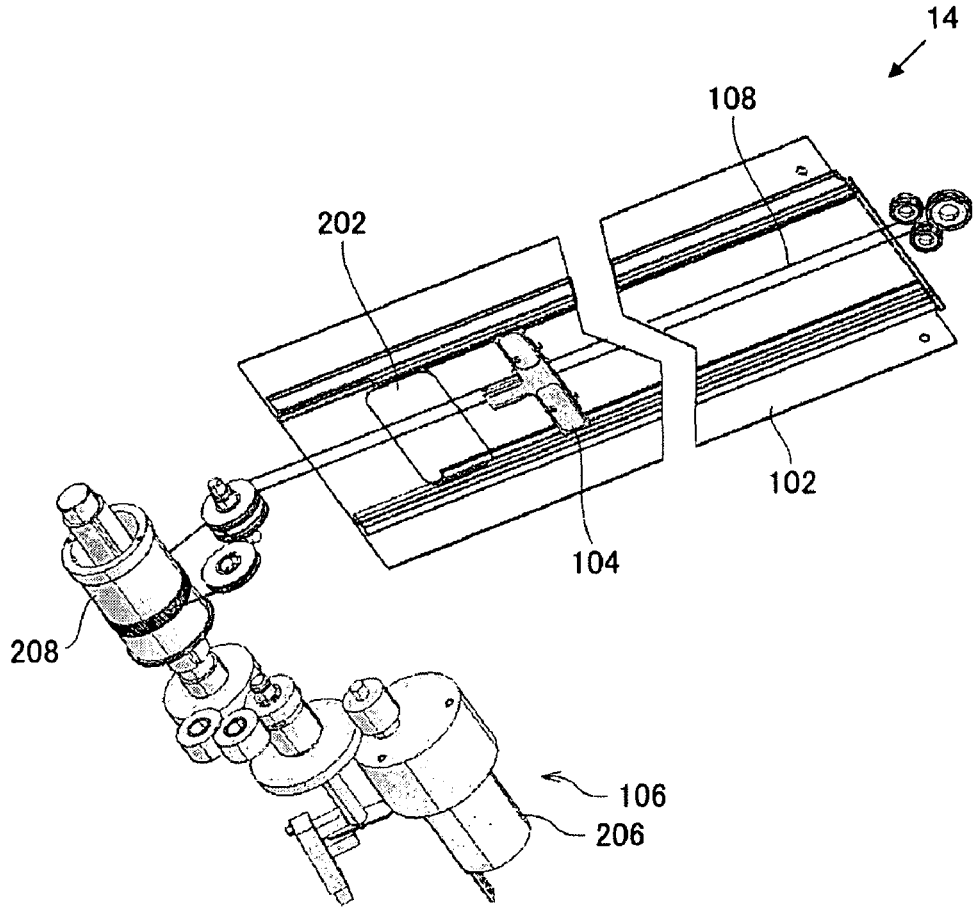
FIG. 6 is a perspective view of a bottom side of the ink receiver 102 as taken from the front right.

FIG. 5 and FIG. 6 are perspective views schematically showing an example of specific structure of the driving section 106 with the ink receiver 102, the wiper member 104, and the wire 108. FIG. 5 is a perspective view of an upper side of the ink receiver 102 as seen diagonally from rear left. FIG. 6 is a perspective view of a bottom side of the ink receiver 102 as seen diagonally from front right.

In this example, the driving section 106 includes a driving motor 206, a motor pinion gear, a drive gear A, a power transmitting shaft, a drive gear B, a motor timing control fin, a torque limiter, a motor control photosensor, two idler gears, a drum drive gear, a drum shaft, a wire drum 208, pulleys C, a turn-around pulley A, and turn-around pulleys B.

Among them, the driving motor 206, the motor pinion gear 400, the drive gear A 402, the power transmitting shaft 404, the drive gear B 406, the motor timing control fin 408, the torque limiter 410, the motor control photosensor 412, and the two idler gears 414 are disposed on the main body 12 (see FIG. 1). The drum drive gear 416, the drum shaft 418, the wire drum 208, the pulleys C 420, the turn-around pulley A 422, and the turn-around pulleys B 424 are disposed on the ink receiving unit 14. These components other than the turn-around pulley A and the turn-around pulleys B are disposed on one end side of the ink receiving unit 14. The turn-around pulley A and the turn-around pulleys B are disposed on the other end side of the ink receiving unit 14, i.e. the opposite side of the ink receiver 102.

The driving motor 206 is a motor which rotates in response to command of the controller 18. The motor pinion gear is attached to the rotary shaft of the driving motor 206 so that the motor pinion gear rotates according to the rotation of the driving motor 206. The drive gear A meshes with the motor pinion gear so that the drive gear A rotates according to the rotation of the motor pinion gear. The power transmitting shaft is a shaft for holding the drive gear A. The power transmitting shaft also holds the drive gear B, the torque limiter, and the motor timing control fin coaxially with the drive gear A. Accordingly, the drive gear B and the motor timing control fin rotate according to the rotation of the drive gear A. The torque limiter limits the rotary torque of the drive gear A. The motor control photosensor is a sensor for detecting the rotation speed of the motor timing control fin and feeding back the detection result to the controller 18. Based on the rotation speed detected by the motor control photosensor, the controller 18 controls the output to the driving motor 206.

The two idler gears are gears for alignment of the drum drive gear. For mounting the ink receiving unit 14 to the main body 12, the two idler gears mesh with the drum drive gear on the ink receiving unit 14 and the drive gear B on the main body 12. Accordingly, the drum drive gear rotates according to the rotation of the drive gear B. The drum shaft is a shaft for holding the drum drive gear and the wire drum 208 coaxially. The wire drum 208 is a drum on which the wire 108 is wound. As the wire drum 208 rotates according to the rotation of the drum drive gear, the wire drum 208 moves the wire 108, to which the wiper member 104 is attached, according to the output of the driving motor 206. The pulleys C are disposed between the wire drum and the ink receiver 102 and cooperate together with the turn-around pulley A and the turn-around pulleys B, arranged on the opposite side of the ink receiver 102, to position the wire 108 such that the wire 108 extends along the ink receiver 102 with some tension.

In this example, the wiper member 104 can be suitably operated by the driving section 106 moving the wire 108. Therefore, the ink in the ink receiver 102 can be suitably removed. Also in this example, the driving motor 206 and the wire drum 208 are positioned such that their rotary shafts extend parallel to each other. In addition, the rotary shafts of the respective gears between the driving motor 206 and the wire drum 208 also extend parallel to each other. According to this example, the power of the driving motor can be reliably transmitted to the wire drum with a simple structure.

In the driving section 106 of this example, one way, to which the wiper member 104 is attached, of a round trip (loop) of the wire 108 tensioned in the ink receiver 102 is set to the center in the width direction of the ink receiver 102. The pulleys C are arranged between the wire drum and the ink receiver 102, and the turn-around pulley A and the turn-around pulleys B are disposed on the opposite side of the ink receiver 102 so that the other way to which the wiper member 104 is not attached (hereinafter, sometimes referred to as "returning way") is set near the center in the width direction of the ink receiver 102 so that the returning way is located above the wire connecting portion 304 of the wiper member 104.

The widespread portion 302 of the wiper member 104 expands in the width direction of the ink receiver 102. Therefore, the wiper member 104 easily contacts with the returning way of the wire 108 at any portion. As the wiper member 104 and the returning way of the wire 108 contact with each other, the wiper member 104 is subjected to the force in the direction opposite to the advancing direction. If the returning way of the wire 108 is apart from the center in the width direction of the ink receiver 102, large rotary torque is applied to the wiper 104 so that the wiper member 104 may easily rattle during the operation when the wiper member 104 and the returning way of the wire 108 contact with each other.

To solve this problem, in this example, the returning way of the wire 108 is set near the center in the width direction of the ink receiver 102 such that the returning way of the wire 108 is located above the wire connecting portion 304 of the wiper member 104. In this case, even if the wiper member 104 is subjected to the force from the returning way of the wire 108, large rotary torque is difficult to be produced. Therefore, according to this example, the rattling during the operation can be suitably prevented so that the wiper member 104 can suitably travel. This enables further suitable removal of the ink in the ink receiver 102.

Figure 7A:
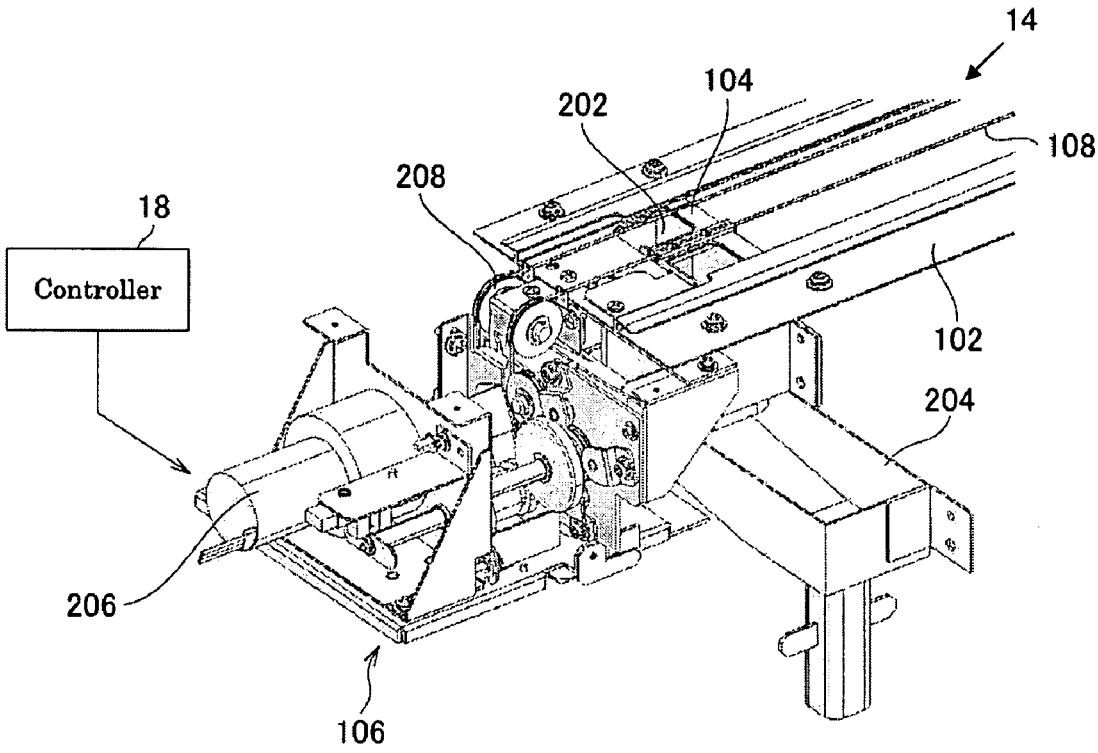
FIGS. 7(*a*), 7(*b*) are illustrations showing a second example of specific structure of the ink receiving unit 14, where FIG. 7(*a*) shows the structure of one end side of the ink receiving unit 14.
Figure 7B:
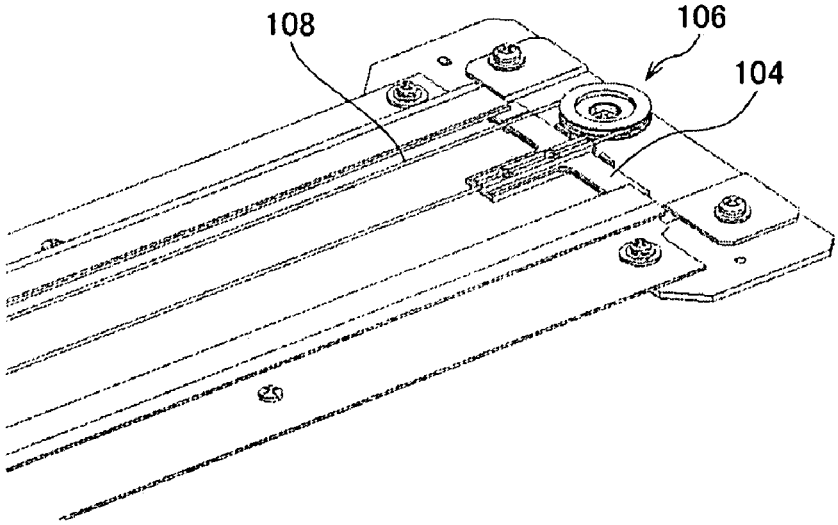

FIGS. 7(*a*) and 7(*b*) show a second example of specific structure of the ink receiving unit 14. FIG. 7(*a*) shows the structure of one end side of the ink receiving unit 14 as well as the structure of some components of the main body 12 (see FIG. 1). FIG. 7(*b*) shows the structure of the other end side of the ink receiving unit 14. Besides points as will be described below, components with the same reference numerals as FIGS. 4(*a*) and 4(*b*) are the same components as those in the structure shown in FIGS. 4(*a*) and 4(*b*).

In this example, the rotary shaft of the driving motor 206 of the driving section 106 extends parallel to the main scanning direction of the printing apparatus 10 (see FIG. 1). This arrangement can achieve reduction of size in the depth direction of the driving section 106, i.e. the sub scanning direction of the printing apparatus 10. Further, this arrangement can prevent the printing apparatus 10 from growing in size due to installation of the ink receiving unit 14, for example.

Also in this example, no pulley is arranged between the wire drum 208 and the ink receiver 102. In addition, only one turn-around pulley is arranged on the opposite side of the ink receiver 102. Accordingly, this arrangement can reduce the number of components of the driving section 106. Further, this arrangement can suitably reduce the cost of the ink receiving unit 14, for example.

Figure 8A:
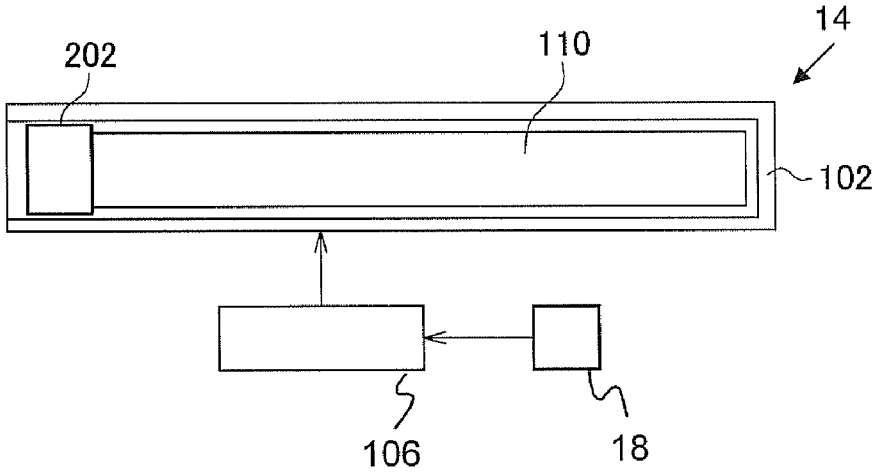
FIGS. 8(*a*), 8(*b*) are illustrations schematically showing a variation of the structure of the ink receiving unit 14, where FIG. 8(*a*) is a top view of the ink receiving unit 14, and FIG. 8(*b*) is a sectional side view of the ink receiving unit 14.
Figure 8B:
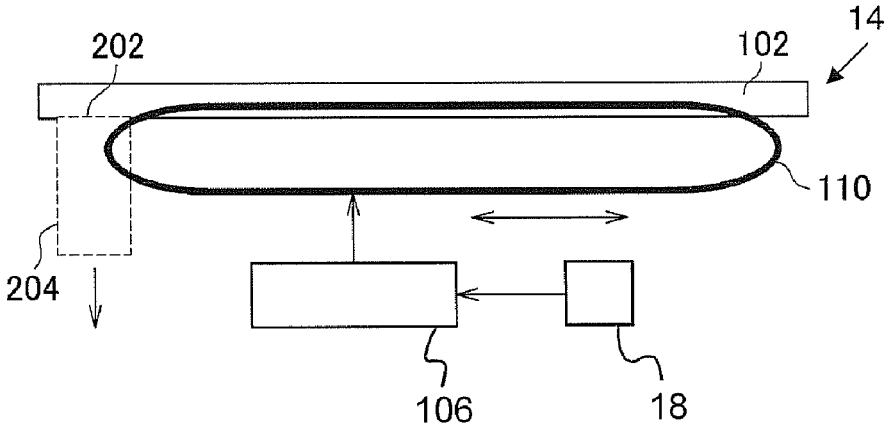

FIGS. 8(*a*) and 8(*b*) schematically show a variation of the structure of the ink receiving unit 14. FIG. 8(*a*) is a top view of the ink receiving unit 14. FIG. 8(*b*) is a sectional side view of the ink receiving unit 14. Besides points as will be described below, components with the same reference numerals as FIGS. 4(*a*) and 4(*b*) are the same components as those in the structure shown in FIGS. 4(*a*) and 4(*b*).

In this example, the ink receiving unit 14 has a belt member 110 as the ink removing means, instead of the wiper member 104 (see FIGS. 4(*a*) and 4(*b*)). The belt member 110 is a band-like member having a movable ink receiving surface. In a state that the ink receiving unit 14 is attached to the main body 12, the belt member 110 extends in the main scanning direction over the bottom surface of the gutter-like ink receiver 102. The driving section 106 moves the belt member 110 by a mechanism similar to that for a belt of a moving walkway, a belt conveyor, or the like. Therefore, the belt member 110 moves along the bottom surface of the ink receiver 102 so as to remove the ink in the receiver 102. Also according to this example, the ink in the ink receiver 102 can be suitably removed.

Though the present invention has been described with regard to the embodiments, the technical scope of the present invention is not limited to the scope described in the aforementioned embodiments. It will be apparent to those skilled in the art that various modifications and improvements can be applied to the aforementioned embodiments. It is apparent from the claims of the present invention that embodiments with such modifications and improvements are within the technical scope of the present invention.

The present invention can be suitably applied to a printing apparatus, for example.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. A printing apparatus for printing on a medium through which ink ejected onto a surface of the medium is allowed to seep to a back side of the medium, said printing apparatus comprising:

an inkjet head configured to eject ink in accordance with an inkjet method;

an ink receiver that is arranged at a position facing said inkjet head across the medium during printing to receive ink dripping from the back side of the medium; and an ink remover attached to the ink receiver and slidably movable along the ink receiver to remove the ink in said ink receiver from said ink receiver.

2. A printing apparatus as claimed in claim 1, wherein said printing apparatus is a scanning printing apparatus which is configured to print while said inkjet head is reciprocated in a predetermined main scanning direction, and wherein said ink receiver is a gutter member extending in said main scanning direction.

3. A printing apparatus as claimed in claim 2, wherein said ink remover comprises a wiper member that is slidable along said ink receiver and is configured to remove the ink in said ink receiver by traveling within said ink receiver in said main scanning direction.

4. A printing apparatus as claimed in claim 3, further comprising:

a controller configured to control operation of said wiper member in said main scanning direction, said controller being configured to change a stand-by position of said wiper member for every operation in which said wiper member travels a predetermined amount, said stand-by position being a position within said ink receiver where said wiper member stands by when it is not in operation.

5. A printing apparatus as claimed in claim 2, wherein said ink remover comprises a belt member extending in said main scanning direction over a bottom surface of said gutter ink receiver and is configured to move along said bottom surface of said ink receiver to remove the ink in said ink receiver.

6. A printing apparatus to print on a medium, said printing apparatus comprising:

an inkjet head configured to eject ink on a front surface of the medium;

an ink receiver arranged at a position facing said inkjet head during printing to receive ink dripping from a back side of the medium; and an ink remover attached to the ink receiver and slidably movable along the ink receiver to remove the ink in said ink receiver.

7. A printing apparatus as claimed in claim 6, wherein said printing apparatus is a scanning printing apparatus which is configured to print while said inkjet head is reciprocated in a predetermined main scanning direction, and wherein said ink receiver is a gutter member extending in said main scanning direction.

8. A printing apparatus as claimed in claim 7, wherein said ink remover comprises a wiper member that is slidable along said ink receiver and is configured to remove the ink in said ink receiver by traveling within said ink receiver in said main scanning direction.

9. A printing apparatus as claimed in claim 8, further comprising:

a controller configured to control operation of said wiper member in said main scanning direction, said controller being configured to change a stand-by position of said wiper member for every operation in which said wiper member travels a predetermined amount, said stand-by position being a position within said ink receiver where said wiper member stands by when it is not in operation.

10. A printing apparatus as claimed in claim 7, wherein said ink remover comprises a belt member extending in said main scanning direction over a bottom surface of said gutter ink receiver and is configured to move along said bottom surface of said ink receiver to remove the ink in said ink receiver.

11. A printing apparatus as claimed in claim 6, wherein said printing apparatus is a printing apparatus of a scanning type in which the printing is conducted while reciprocating said inkjet head in a previously set main scanning direction, and wherein said ink receiver is a gutter-like member extending in said main scanning direction.

12. A printing apparatus to print on a medium, said printing apparatus comprising:

inkjet head means for ejecting ink on a front surface of the medium;

an ink receiver arranged at a position facing said inkjet head means during printing to receive ink dripping from a back side of the medium; and ink removing means for removing the ink in said ink receiver, the ink removing means being slidably movable along the ink receiver to remove the ink in said ink receiver.

* * * * *